US005406353A

United States Patent [19]

Asanae

[11] Patent Number: 5,406,353

[45] Date of Patent: Apr. 11, 1995

[54] PORTABLE ELECTROPHOTOGRAPHIC PRINTER HAVING MAGNETIC CHARGING DEVICE

[75] Inventor: Masumi Asanae, Kumagaya, Japan

[73] Assignee: Hitachi Metals, Ltd., Tokyo, Japan

[21] Appl. No.: 80,513

[22] Filed: Jun. 24, 1993

[30] Foreign Application Priority Data

Jun. 26, 1992 [JP] Japan ..... 4-168122

[51] Int. Cl.[6] ..... G03G 15/00

[52] U.S. Cl. ..... 355/200; 355/219; 361/225

[58] Field of Search ..... 355/206, 202, 210–213, 355/219, 282, 285, 290; 219/216, 469, 470; 346/153.1, 160.1; 358/296; 361/225, 230

[56] References Cited

U.S. PATENT DOCUMENTS

| | | | |
|---|---|---|---|
| 4,387,984 | 6/1983 | Sato | 355/212 |
| 4,640,880 | 2/1987 | Kawanishi et al. | 430/106.6 |
| 4,833,547 | 5/1989 | Mase | 358/296 |
| 4,891,294 | 1/1990 | Noguchi | 430/110 |
| 4,959,688 | 9/1990 | Koitabashi | 355/219 |
| 5,051,784 | 9/1991 | Yamamoto et al. | 355/285 |
| 5,064,739 | 11/1991 | Asanae et al. | 430/122 |

FOREIGN PATENT DOCUMENTS

| | | | |
|---|---|---|---|
| 0474220 | 3/1992 | European Pat. Off. | 355/219 |
| 63-187267 | 8/1988 | Japan | 355/219 |
| 1-86163 | 3/1989 | Japan | 355/200 |
| 4-109262 | 4/1992 | Japan | 355/219 |

*Primary Examiner*—William J. Hoyer
*Attorney, Agent, or Firm*—Finnegan, Henderson, Farabow, Garrett & Dunner

[57] ABSTRACT

An electrophotographic printer is disclosed with the printer having a cylindrical, electrostatic latent image-bearing member, a non-corona-discharge electric charging device, an electrostatic latent image former, a developer, a device for transferring the developed image onto a recording medium, a cleaner for cleaning the surface of the latent image-bearing member, and a fixing device located downstream of the latent image bearing member for heat fixing a developed image onto the recording medium. The charging device is provided by a permanently magnetized charging roll and magnetic powder having an intrinsic volume resistance of $10^2$–10 Ω.cm. The magnetic powder is attracted onto the charging roll forming a magnetic brush without an externally applied bias voltage on the surface of the charging roll.

7 Claims, 2 Drawing Sheets

PORTABLE ELECTROPHOTOGRAPHIC PRINTER HAVING MAGNETIC CHARGING DEVICE

BACKGROUND OF THE INVENTION

The present invention relates to an electrophotographic printer utilizing a means for forming an electrostatic latent image corresponding to information to be printed, on an image-bearing member, a means for developing the electrostatic latent image with a magnetic developer containing magnetic toner, a means for transferring the developed image to a recording medium, and a means for heat-fixing the developed image to the recording medium, and more particularly to an electrophotographic printer which has reduced thinness and improved portability.

In a conventional electrophotographic printer, an electrostatic latent image corresponding to a printer output (information to be printed) is generally formed on a cylindrical photosensitive drum, brought into contact with a magnetic brush of a magnetic developer conveyed on a developing roll containing a permanent magnet roll and disposed opposite the photosensitive drum, so that it is developed (visualized as a toner image). The developed image is then transferred onto a recording paper and heat-fixed.

The magnetic developer usable for a magnetic brush method, as mentioned above, is in many cases a two-component developer consisting of a magnetic carrier and a non-magnetic toner. However, in the case of using such a two-component developer, a concentration sensor and other members are required, making it difficult to miniaturize an electrophotographic printer satisfactorily. Accordingly, a one-component developer consisting of a magnetic toner, or a magnetic developer consisting of a magnetic toner and a magnetic carrier is mostly used for the electrophotographic printer.

With the above magnetic developer, the electrophotographic printer can be miniaturized to some extent, but there is a limit in the conventional electrophotographic printer. That is, since the conventional electrophotographic printer has a heat-fixing means comprising a heat roll containing a heat source and a pressure roll for pressing the recording paper to the heat roll, and since these rolls are provided with paper-separating fingers and other accessories, it is impossible to reduce the height of the roll pair of the heat-fixing means drastically. Accordingly, it has been impossible to make the conventional electrophotographic printer have an extremely reduced thickness.

A charging means and a transfer means in a conventional electrophotographic printer are usually of corona charging type which utilizes corona discharge occurred by applying high voltage (DC 5–8 kV) to a metal wire. In these means, however, ozone and nitrogen oxides are generated by the corona discharge while being accompanied with unpleasant odor which leads to environmental pollution. Also, the ozone and nitrogen oxides generated by the corona discharge gradually deteriorate the surface of the photosensitive drum, resulting in poor image resolution. In addition, dust attached to the wire in the charging means affects the image quality, causing white spots and black streaks on the resulting image.

In a transfer means utilizing corona discharge, a toner image on the photosensitive drum is electrostatically transferred onto a recording medium by applying a charge to the rear of the recording medium with a polarity opposite to that of the toner image This means that the transferability varies with the electric resistance of the recording medium, and further with the humidity that affects the electric resistance of the recording medium. Specifically, the transferability of the image is low when the electric resistance of a recording medium is low.

Further, in the charging means and transfer means which utilize the corona discharge, the electric current actually supplied to the photosensitive drum or recording medium is 5–30% of that supplied from the power source, because the rest streams into a shield plate. Due to this low electric efficiency, it is inevitable to consume considerably greater amounts of electricity than that actually needed in the charging means or transfer means, thereby requiring a set-up transformer of greater capacity.

In the meantime, demands for a portable (handcarried) electrophotographic printer as well as for a stationary one have greatly increased recently. Although such a portable electrophotographic printer has already been commercialized for a type using heat-sensitive papers, the information or image recorded on the heat-sensitive papers will disappear as time passes. Accordingly, for the purpose of printing information which should be kept for a long period of time, the heat-sensitive paper type electrophotographic printer is not suitable.

OBJECT AND SUMMARY OF THE INVENTION

Accordingly, an object of the present invention is to provide a thin, hand-carried electrophotographic printer which generates no or greatly reduced amounts of ozone, nitrogen oxides, etc., thereby obviating any problems inherent in the conventional electrophotographic printer.

To achieve the above object, the present invention provides an electrophotographic printer comprising an image-forming unit composed of a cylindrical electrostatic latent image-bearing member; a charging means, an electrostatic latent image-forming means, a developing means equipped with a magnet roll onto which a magnetic developer containing a magnetic toner is attracted, a transfer means for transferring the developed image on the surface of the electrostatic latent image-bearing member onto a recording medium, and a cleaning means for cleaning the surface of the electrostatic latent image-bearing member after transferring of the developed image, respectively disposed near the electrostatic latent image-bearing member; and a fixing means disposed downstream of the electrostatic latent image-bearing member for heat-fixing the developed image onto the recording medium, wherein the charging means is constituted by a charging roll composed of a permanent magnet and magnetic powder having an intrinsic volume resistance of $10^2$–$10^9$ Ω.cm and being attracted onto the charging roll so that the magnetic powder forms on a surface of the charging roll a magnetic brush which comes into sliding contact with the electrostatic latent image-bearing member, and wherein an outer diameter of the electrostatic latent image-bearing member is 40 mm or less, an outer diameter of the magnet roll is 30 mm or less, and a height of the image-forming unit is 60 mm or less.

DETAILED DESCRIPTION OF THE INVENTION

The present invention will be described in detail below.

[1] Overall structure of the printer

Before describing the details of the charging means and the transfer means, the overall structure of the electrophotographic printer will be explained briefly.

Figure 1:
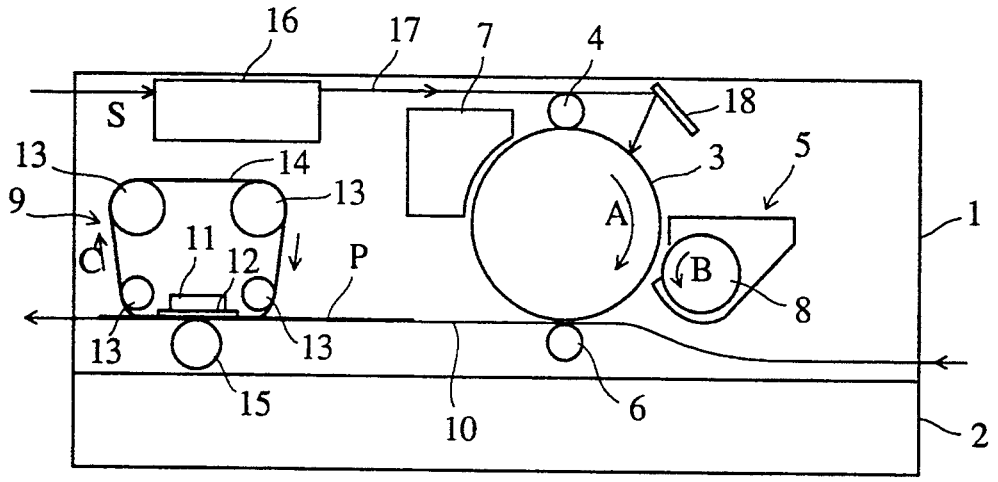
FIG. 1 is a schematic view showing an electrophotographic printer according to the present invention.

Referring to FIG. 1, the image-forming unit 1 integrally mounted to a control unit 2 comprises a cylindrical photosensitive drum 3 having an outer surface coated with a photosensitive layer (not shown) made of zinc oxide or an organic semiconductor, which is rotatable in the direction shown by the arrow A. Disposed in the vicinity of an outer surface of the cylindrical photosensitive drum 3 are a charging means 4, a developing means 5, a transfer means 6, and a cleaning means 7. The developing means 5 contains a magnet roll 8 rotatable in the direction shown by the arrow B and composed of a sleeve and a magnet disposed in the sleeve as disclosed in U.S. Pat. No. 5,064,739.

A fixing means 9 is disposed on the downstream side of the cylindrical photosensitive drum 3 along a path 10 of a recording paper P in the image-forming unit 1. The fixing means 9 is constituted by a heating means comprising a substrate 11 made of heat-resistant, insulating material such as alumina and a heater means 12 made of an electric resistance material and formed on the substrate 11, a plurality of rollers 13, an endless belt 14 movable along a path around the heater means 12 and the rollers 13 in the direction shown by the arrow C, and a rotatable pressure roll 15 disposed in the vicinity of the heater means 12 for pressing the recording paper P to the heater means 12 via the belt 14.

The endless belt 14 may have a thickness of 100 μm or less, preferably 20–50 μm, and may be made of a heat-resistant material such as polyimide, polyetherimide, etc. The endless belt 14 is coated with a releasing layer made of fluoroplastics such as polytetrafluoroethylene (PTFE), perfluoroalkoxy resins (PFA), etc. at a thickness of 1–20 μm, particularly about 10 μm on the surface facing the toner image on the recording medium P (lower surface in FIG. 1). The pressure roll 15 is coated with an elastic layer having a good releasing property such as a silicone rubber, etc. The pressure roll 15 may come into contact with the heater means 12 via the belt 14 and the paper P at a linear pressure of 0.1–1 kg/cm, preferably 0.5 kg/cm.

Incidentally, the belt 14 is not restricted to an endless belt, but the belt 14 may have a limited length, if it is wound around a pair of rolls apart from each other, and if these rolls are rotated in the same direction. In this case, the belt 14 is wound around one roll while it is unwound from another roll at any time, whereby the belt 14 moves back and forth through a gap between the heating member 12 and the pressure roll 15.

A laser scanner 16 is mounted to an upper part of the image-forming unit 1. In response to an electric signal S corresponding to information or an image to be printed, the laser scanner 16 supplies a laser beam 17 toward a mirror 18, by which the laser beam 17 is reflected and impinges a surface of the cylindrical photosensitive drum 3. The driving mechanism (not shown) and the laser scanner 16 contained in the image-forming unit 1 are electrically connected to the control unit 2, so that their operations are controlled.

The electrophotographic printer having the above structure is operated as follows:

After putting the image-forming unit 1 into an operating condition via the control unit 2, an electric signal S corresponding to information or an image is supplied to the laser scanner 16. Next, the photosensitive drum 3 is charged uniformly by a charging means 4, and the laser beam 17 generated by the laser scanner 16 according to the electric signal S is impinged onto the charged surface of the photosensitive drum 3 to form an electrostatic latent image. The electrostatic latent image is developed with a magnetic toner conveyed by the magnet roll 8 comprising a cylindrical sleeve and a permanent magnet member rotating relatively to the sleeve. The developed image (toner image) is then transferred onto a recording paper P conveyed along the recording paper path 10 by means of the transfer means 6. After transfer of the developed toner image, the magnetic toner remaining on the photosensitive drum 3 is removed by a cleaner 7 having a cleaning blade (not shown), and the next electrostatic latent image is formed on the photosensitive drum 3.

The recording paper P carrying the toner image is conveyed to the fixing means 9, where the recording paper P passes through a gap between the belt 14 movable in contact with the heating member 12 and the pressure roll 15. Since heat supplied from the heating member 12 is transmitted to the toner image on the recording paper P via the belt 14, the binder resin in the magnetic toner is melted, whereby the toner image is fixed to the recording paper P.

Figure 3:
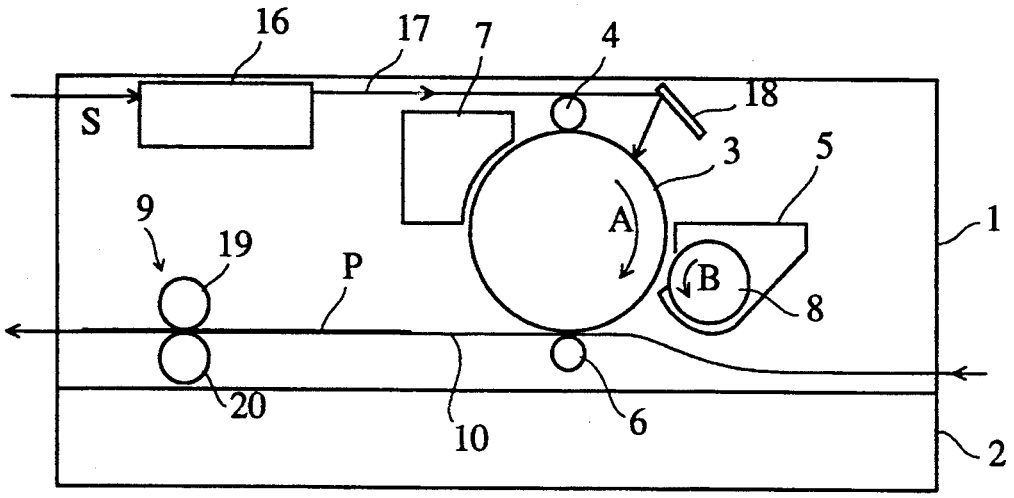
FIG. 3 is a schematic view showing another electrophotographic printer according to the present invention.

Another electrophotographic printer of the present invention is shown in FIG. 3 in which the same reference numerals are assigned to the same components as in FIG. 1. In this electrophotographic printer, the fixing means 9 is constituted by a heating roll 19 and a pressure roll 20 both rotatable in pressed contact with each other. Each of the heating roll 19 and the pressure roll 20 has an outer diameter of 20 mm or less, preferably 10–20 mm, and they are pressed to each other at a linear pressure of 0.1–1 kg/cm, preferably 0.5 kg/cm.

The fixing means 9 comprises a heat roll 19 which may contain a heat source (not shown) such as a halogen lamp, or which may be of a so-called direct heat type having an outer surface provided with a heat-generating layer made of an electric resistance material, etc. Specifically, the heating roll 19 may be composed of a cylindrical core member made of aluminum, etc., a heating layer made of an electric resistance material and formed on an outer surface of the core member, and a releasing layer made of PTFE having a thickness of 1–20 μm, particularly about 10 μm. On the other hand, the pressure roll 20 may be composed of a cylindrical core member made of the same material as in the heating roll 19, and an outer layer made of a silicone rubber and formed on an outer surface of the core member.

The heating roll 19 may also be constituted by a core member made of a ceramic material and a heating member embedded in the core member.

[2] Charging means

Figure 2:
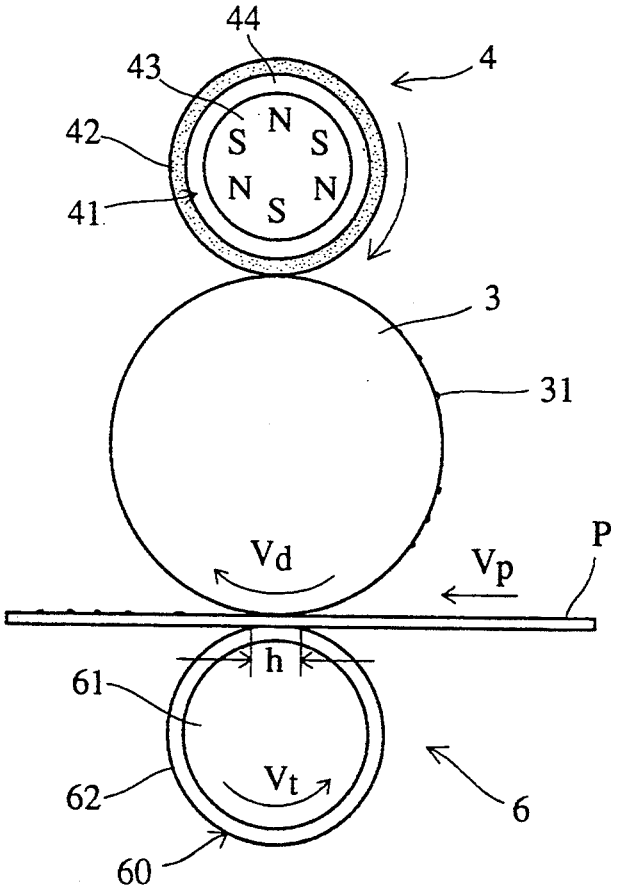
FIG. 2 is an enlarged view showing a charging means, cylindrical photosensitive drum, and transfer means in the electrophotographic printer shown in FIG. 1.

FIG. 2 shows the charging means 4 and the transfer means 6 disposed near the photosensitive drum 3 in detail. The charging means 4 is composed of a charging roll 41 and a magnetic brush 42 formed thereon. The charging roll 41 can be rotated in either direction, clockwise or counterclockwise. The charging roll 41 may be constituted by a cylindrical core member 43 made of a sintered permanent magnet such as hard ferrite or a resin-bonded permanent magnet and a sleeve 44 made of a non-magnetic material. In this case, the cylindrical core member 43 is rotatably disposed in the sleeve 44 and has on the outer surface a plurality of (for example, six) axially extending magnetic poles arranged alternately like N, S, N, S, . . . in a circumferential direction with identical intervals. Incidentally, the charging roll 41 may not have the sleeve 44 in some cases. Also, DC or AC voltage may be applied to the sleeve 44.

The magnetic powder is attracted onto the surface of the charging roll 41 and forms a magnetic brush 42 which rubs the surface of a photosensitive drum 3 to have it charged with a certain polarity. The intrinsic volume resistance of the magnetic powder is $10^2 10^9$ Ω.cm. If the intrinsic volume resistance of the magnetic powder is less than $10^2$ Ω.cm, the magnetic powder would move to the surface of the image-bearing member 3, resulting in a deteriorated image quality. On the other hand, if the intrinsic volume resistance of the magnetic powder is larger than $10^9$ Ω.cm, it would not be possible to keep the charge level on the surface of the image-bearing member 3 at a predetermined level, which may lead to insufficient charging.

Specific examples of the magnetic powder used include iron powder, ferrite particle (for instance, Ni—Zn ferrite, Mn—Zn ferrite, Cu—Zn ferrite, etc.) and magnetite particle, which are conventionally used as a carrier for a two-component developer. Usable as the magnetite particle are, as disclosed by Japanese Patent Laid-Open No. 63-184764, those having one or more non-magnetic oxide phases selected from the group consisting of Si, Ca, Al, Mg, Fe, V, Sb, Pb, Cu and Mn dispersed in a matrix mainly composed of magnetite; and those obtained by mixing iron oxide powder consisting mainly of hematite and one or more non-magnetic oxides selected from the group consisting of Si, Ca, Al, Mg, Fe, V, Sb, Pb, Cu and Mn, granulating the resulting mixture and heat-treating it in an inert gas atmosphere containing 5 volume % or less of oxygen at 1000°-1400 ° C. to reduce the hematite only to convert it to magnetite.

The above magnetic powder used in the present invention preferably has an average particle size of 20-200 μm. Such magnetic powder may be produced by granulation from a fine powder having a particle size of 5 μm or less. The magnetic powder may be in an uncoated state or may be coated with resins (for example, fluoroplastics, styrene resins, polyester resins, epoxy resins, and mixtures thereof) containing conductive particles such as carbon black, etc. A resin-bonded magnetic powder produced by coating core particles composed of the above magnetic powder and binder resin with conductive particles, may also be usable in the present invention.

Incidentally, usual magnetic toners having an average particles size of 5-20 μm may also be employed as the magnetic powder. These magnetic toners usually contain 20-80 weight % of magnetic powder and conductive particle added thereto internally and/or externally. When the amount of the magnetic powder contained is less than 20 weight %, the magnetic toner is not well attracted to a charging roll 41 and tends to be scattered, thereby polluting the vicinity of the charging means 4. On the other hand, when the amount of the magnetic powder contained exceeds 80 weight %, it is difficult to form the magnetic toner particle due to the shortage of binder resin, and even if it were formed, the resulting magnetic toner would have a lower mechanical strength, suffering from a short service life.

[3] Transfer means

The transfer means may be either a slip-type one or press-type one in the present invention. The slip-type transfer means is composed of a transfer roll constituted by a core member made of a rigid material such as metal, and an outer layer made of materials with flexibility and elasticity such as rubber. The press-type transfer means is composed of a transfer roll constituted by the same core member alone, or in combination with an outer layer made of a rigid material. In this transfer means, a nip between the transfer roll and the image-bearing member is narrower than that of the slip-type means, thereby increasing pressure applied to the image-bearing member.

In the transfer means of the slip-type, the outer layer 62 of the transfer roll 60 is produced by such a material that a friction coefficient ($\mu_{tp}$) between the transfer roll 60 (namely, the outer layer 62) and a recording paper P is greater than a friction coefficient ($\mu_{dp}$) between the photosensitive drum 3 and the recording paper P. Further, the velocity ($V_d$) of the photosensitive drum 3 is set greater than that ($V_t$) of the transfer roll 60. The velocity ($V_p$) of recording paper P may be set nearly equal to the velocity ($V_t$) of the transfer roll 60. Under these conditions, the transfer roll 60 and the photosensitive drum 3 are respectively rotated, and there occurs a slip between the recording paper P and the photosensitive drum 3 due to the velocity difference, thereby transferring the toner image 31 onto the recording paper P by means of a slip action (mechanical separating force).

In the above slip-type transfer means, the transfer efficiency depends on the slip length and surface pressing force of the transfer roll 60. The slip length (L) is expressed by the following formula:

$$L=(h/V_t)\times(V_d-V_t),$$

wherein h represents a nip width (a length in the circumferential direction in which the photosensitive drum 3 and the transfer roll 60 are in pressed contact with each other). As explained before, the transfer of toner image 31 onto the recording paper P (specifically onto the fibers of a plain paper used as the recording paper P) is accomplished while the recording paper P is in slipping contact with the photosensitive drum 3. Because of this mechanism, the slip length greatly affects the transfer efficiency.

As the surface pressing force of the transfer roll 60 to the photosensitive drum 3 becomes greater, the probability of the fibers of the recording paper P coming into contact with the toner image becomes higher, because the flatness of the recording paper P is raised relative to the pressing force. Thus, the surface pressing force of the transfer roll 60 is another factor affecting the transfer efficiency.

Accordingly, in the slip-type transfer means, the transfer efficiency becomes higher as the slip length and surface pressing force increase. However, it was experimentally confirmed that the increase in the slip length caused a decrease in resolution of the image obtained. Likewise, the lower transfer efficiency would lead to the higher image resolution in the slip-type transfer means. Therefore, the slip length should be determined depending on the properties required for the electrophotographic printer.

To increase both the transfer efficiency and the image resolution simultaneously, it is useful to utilize a press-type transfer means. In this case, a transfer roll 60 having an outer layer 62 made of a rigid material such as polyacetal in a thickness of 2.5 mm may be used. With this transfer roll, the nip width becomes narrower than in a case where a transfer roll having an outer layer of flexible material is used, even at the same linear pressure. This leads to a greater surface pressing force, thereby improving the transfer efficiency and the image resolution. With a transfer roll 60 made of aluminum alloy and having no outer layer 62, the same effect was confirmed. Accordingly, it is understood that the transfer efficiency is determined by the surface pressing force, and the image resolution and the transfer efficiency are improved simultaneously in the press-type transfer means.

Incidentally, a conventional transfer means such as a corona-charging type transfer means can be used in the electrophotographic printer of the present invention.

[4] Parameters

In the electrophotographic printer having the above described construction, when the electrostatic latent image-bearing member 3 has an outer diameter exceeding 40 mm, and when the magnet roll 8 has an outer diameter exceeding 30 mm, the image-forming unit 1 becomes too high, failing to make the electrophotographic printer thin and portable. Therefore, the electrostatic latent image-bearing member 3 should have an outer diameter of 40 mm or less, preferably 30 mm or less, and the magnet roll 8 should have an outer diameter of 30 mm or less, preferably 20 mm or less, so that the height of the image-forming unit 1 can be made as small as 60 mm or less. A peripheral speed of the image-bearing member is preferably 60 mm/sec or less, more preferably 20–50 mm/sec. The fixing speed is thus preferably 60 mm/sec or less, more preferably 20–50 mm/sec. With these peripheral speed and fixing speed (both called "process speed"), the electrostatic latent image-bearing member 3 having as small an outer diameter as 40 mm or less can be used, and the convey speed of the magnetic developer can be suppressed, which makes it possible to reduce the outer diameter of the magnet roll 8 to 30 mm or less. Therefore, a torque necessary for rotating the magnet roll 8 can be reduced, which in turn makes a driving means smaller.

[5] Magnetic developer

The magnetic developer usable in the present invention is (a) a magnetic toner consisting mainly of a binder resin and a magnetic :powder, or (b) a mixture of a magnetic toner and a magnetic carrier. In the case where the magnetic developer (b) is used, the toner concentration is set within the range of 10–90 weight %, preferably 10–60 weight %, more preferably 15–30 weight %. Examples of the binder resins include styrene resins such as polystyrene, styrene-acrylic copolymers, styrene-butadiene copolymers, etc.

The magnetic powder is made of compounds or alloys containing ferromagnetic metals such as iron, cobalt, nickel, etc., for instance, ferrite, magnetite, etc. To disperse the magnetic powder in the binder resin uniformly, it is preferable that the magnetic powder has an average diameter of 0.01–3 μm. The content of the magnetic powder in the magnetic toner is preferably within the range of 10–80 weight %, more preferably 20–60 weight %.

The magnetic toner may contain various additives as in usual developers, such as charge-controlling agents such as nigrosine dies or azo dies containing metals, releasing agents such as olefin polymers, fluidity improvers, fillers, etc. In order to avoid the decrease in a fixability, the total amount of the additives is preferably 15 weight % or less.

The magnetic toner can be prepared by known methods such as a pulverization method, a spray-drying method, or a suspension polymerization method. The volume average diameter of the magnetic toner is preferably within the range of 5–15 μm, more preferably 7–10 μm.

The magnetic carrier usable in the present invention is produced from iron powder, iron oxide (for instance, magnetite), soft ferrite (for instance, Ni-Zn ferrite, Mn-Zn ferrite, Cu-Zn ferrite, Ba-Ni-Zn ferrite), magnetic powder bonded with resin binders, etc. To prevent carrier adhesion and fogging, the magnetic carrier preferably has a magnetization ($\sigma s$) of 40–90 emu/g (measured in a magnetic field (maximum: 10 kOe) by a vibration-type magnetometer (Model VSM-3, manufactured by Toei Industry Co., Ltd.) and an average diameter of 20–105 μm. Also, magnetic powder coated with a resin having an average diameter of 10–100 μm may be used.

The present invention will be explained in further detail by way of the following Examples.

EXAMPLE 1

In the electrophotographic printer having a belt-type fixing means as shown in FIG. 1, Ba-Ni-Zn ferrite powder (KBN-100 manufactured by HITACHI METALS, LTD., particle size distribution: 74–149 μm, intrinsic volume resistance: $10^8$ Ω.cm) was used as a magnetic powder for forming a magnetic brush 42 on a surface of the charging roll 41 in a thickness of 0.7 mm. The charging roll 41 was rotated at 100 rpm so that it rubbed the surface of the photosensitive drum 3. As a result, it was confirmed that the surface of the photosensitive drum 3 was charged properly.

The transfer means 6 was constituted by a transfer roll 60 having an outer diameter of 20 mm. The transfer roll 60 comprises a core member 61 made of stainless steel and an outer coating layer 62 made of ethylene-propylene-diene rubber (EPDM) and having a hardness of Hs 80° and a thickness of 2 mm. This transfer means 6 was arranged so that it was in a pressed contact with the photosensitive drum 3.

The height of the image-forming unit 1 comprising the charging means and the transfer means could be reduced to as small as 55 mm, by reducing the outer diameter of the photosensitive drum 3 having a photosensitive layer made of an organic semiconductor to 30 mm and the outer diameter of the developing roll 8 to 18 mm. Such a small electrophotographic printer is easily carried with a hand.

In this small electrophotographic printer, the following operating conditions were used:

Peripheral speed of photosensitive drum 3=20 mm/sec.,

Fixing temperature =130° C., and

Pressing force of pressure roll 15=0.5 kg/cm.

Image formed on the recording paper under these conditions showed good image density and resolution with good fixability.

EXAMPLE 2

In the electrophotographic printer having roll-pair type fixing means as shown in FIG. 3, an image was formed under the same conditions as in Example 1. As a result, it was confirmed that as good an image as in Example 1 could be formed.

As described above in detail, the electrophotographic printer according to the present invention generates no or reduced amounts of ozone, nitrogen oxides, etc. if any. Further, since the electrophotographic printer of the present invention can be made thin because of the above-described structure, it can serves as a portable printer. Also, since rollers in the fixing means have small diameters, the recording medium would not be wound around the rolls in the fixing means even without separation fingers. Therefore, the fixing means can have a simplified structure, making it possible to reduce the weight and cost of the image-forming unit.

What is claimed is:

1. An electrophotographic printer comprising an image-forming unit including an electrostatic latent image-bearing member having a cylindrical surface; a charging means, an electrostatic latent image-forming means, a developing means having a magnet roll onto which a magnetic developer containing a magnetic toner is attracted, transfer means for transferring a developed image from the surface of said electrostatic latent image-bearing member onto a recording medium, and cleaning means for cleaning the surface of said electrostatic latent image-bearing member after transferring of said developed image, respectively disposed near said electrostatic latent image-bearing member; and a fixing means disposed downstream of said electrostatic latent image-bearing member for heat-fixing said developed image onto said recording medium, wherein said charging means consists essentially of a permanently magnetized charging roll and magnetic powder having an intrinsic volume resistance of $10^2$–$10^9$ Ω.cm being attracted onto said charging roll so that said magnetic powder forms on a surface of said charging roll a magnetic brush which comes into sliding contact with said electrostatic latent image-bearing member, and wherein said electrostatic latent image-bearing member has an outer diameter of 40 mm or less, said charging roll has an outer diameter of 30 mm or less, and said image-forming unit is 60 mm or less in height.

2. The electrophotographic printer according to claim 1, wherein said fixing means includes a pair of fixing rolls each having an outer diameter of 20 mm or less.

3. The electrophotographic printer according to claim 2 wherein said transfer means comprises a transfer roll rotatably disposed in pressed contact with said electrostatic latent image-bearing member.

4. The electrophotographic printer according to claim 1, wherein said fixing means comprises a stationary heating means, a belt movable in contact with said heating means and a pressure means opposite said heating means for pressing said belt to said heating means.

5. The electrophotographic printer according to claim 4, wherein said transfer means comprises a transfer roll rotatably disposed in pressed contact with said electrostatic latent image bearing member.

6. The electrophotographic printer according to claim 1, wherein said transfer means comprises a transfer roll rotatably disposed in pressed contact with said electrostatic latent image-bearing member.

7. An electrophotographic printer comprising an image-forming unit including an electrostatic latent image-bearing member having a cylindrical surface; a charging means, an electrostatic latent image-forming means, a developing means having a magnet roll onto which a magnetic developer containing a magnetic toner is attracted, transfer means for transferring a developed image from the surface of said electrostatic latent image-bearing member onto a recording medium, and cleaning means for cleaning the surface of said electrostatic latent image-bearing member after transferring of said developed image, respectively disposed near said electrostatic latent image-bearing member; and a fixing means disposed downstream of said electrostatic latent image-bearing member for heat-fixing said developed image onto said recording medium, wherein said charging means comprises a permanently magnetized charging roll and magnetic powder having an intrinsic volume resistance of $10^2$–$10^9$ Ω.cm and being attracted onto said charging roll so that said magnetic powder forms on a surface of said charging roll a magnetic brush which comes into sliding contact with said electrostatic latent image-bearing member, said magnetic brush being unbiased, and wherein said electrostatic latent image-bearing member has an outer diameter 40 mm or less, said charging roll has an outer diameter of 30 mm or less, and said image-forming unit is 60 mm or less in height.

* * * * *

UNITED STATES PATENT AND TRADEMARK OFFICE

CERTIFICATE OF CORRECTION

PATENT NO. :5,406,353

DATED :April 11, 1995

INVENTOR(S) :Asanae

It is certified that error appears in the above-indentified patent and that said Letters Patent is hereby corrected as shown below:

Claim 5, Col. 10, line 21, "image bearing" should read --image-bearing--.

Abstract, line 13, "$10^2$-10" should read --$10^2$-$10^9$--.

Signed and Sealed this

Thirtieth Day of May, 1995

Bruce Lehman

*Attest:*

BRUCE LEHMAN

*Attesting Officer*

*Commissioner of Patents and Trademarks*